US011563259B2

(12) United States Patent
Alexanian et al.

(10) Patent No.: US 11,563,259 B2
(45) Date of Patent: Jan. 24, 2023

(54) WAVEGUIDE SIGNAL CONFINEMENT STRUCTURES AND RELATED SENSOR ASSEMBLIES

(71) Applicant: VEONEER US, INC., Southfield, MI (US)

(72) Inventors: Angelos Alexanian, Lexington, MA (US); Scott B. Doyle, Sudbury, MA (US); Arnold Mobius, North Chelmsford, MA (US)

(73) Assignee: Veoneer US, LLC, Southfield, MI (US)

( * ) Notice: Subject to any disclaimer, the term of this patent is extended or adjusted under 35 U.S.C. 154(b) by 337 days.

(21) Appl. No.: 16/789,369

(22) Filed: Feb. 12, 2020

(65) Prior Publication Data

US 2021/0249784 A1 Aug. 12, 2021

(51) Int. Cl.

| | |
|---|---|
| ***H01P 1/162*** | (2006.01) |
| ***H01Q 21/00*** | (2006.01) |
| ***H01P 5/12*** | (2006.01) |

(52) U.S. Cl.

CPC ..... *H01P 1/162* (2013.01); *H01P 5/12* (2013.01); *H01Q 21/005* (2013.01)

(58) Field of Classification Search

CPC ..... H01P 1/1862; H01P 5/12; H01Q 21/005
See application file for complete search history.

(56) References Cited

U.S. PATENT DOCUMENTS

| | | | |
|---|---|---|---|
| 6,686,808 B1 * | 2/2004 | Sugawara | H05K 1/0219 333/1 |
| 7,132,905 B2 | 11/2006 | Sano | |
| 8,779,995 B2 | 7/2014 | Kirino et al. | |
| 8,803,638 B2 | 8/2014 | Kildal | |
| 9,153,851 B2 | 10/2015 | Nakamura | |
| 9,252,475 B2 | 2/2016 | Milyakh et al. | |

(Continued)

FOREIGN PATENT DOCUMENTS

| | | |
|---|---|---|
| CN | 102931492 | 2/2015 |
| CN | 106207357 | 12/2016 |
| WO | 2019022651 | 1/2019 |

OTHER PUBLICATIONS

CN102931492, Feb. 11, 2015, Beijing Institute of Telemetry Technology, Machine Translation (9 pages).

(Continued)

*Primary Examiner* — Samuel S Outten
*Assistant Examiner* — Kimberly E Glenn
(74) *Attorney, Agent, or Firm* — Matthew D. Thayne; Thayne and Davis LLC

(57) ABSTRACT

Antenna and/or waveguide assemblies for vehicles, such as RADAR sensor antenna assemblies, along with associated signal confinement structures. In some embodiments, the assembly may comprise an antenna block defining one or more waveguides. A conductive layer may be coupled to the antenna block to form, at least in part, a wall of the waveguide. The assembly may comprise one or more periodic structures that may be operably coupled to the waveguide, each of which may comprise a first elongated opening and a first series of repeated slots extending at least substantially transverse to the first elongated opening, wherein each of the first series of repeated slots is spaced apart from an adjacent slot in the first series of repeated slots along the first elongated opening.

20 Claims, 11 Drawing Sheets

(56) References Cited

U.S. PATENT DOCUMENTS

| | | | | |
|---|---|---|---|---|
| 9,666,931 | B2 | 5/2017 | Suzuki | |
| 10,164,344 | B2 | 12/2018 | Kirino et al. | |
| 10,327,364 | B2 * | 6/2019 | Oishi | G06K 19/07773 |
| 2011/0050356 | A1 | 3/2011 | Nakamura et al. | |
| 2017/0187121 | A1 | 6/2017 | Kirino et al. | |
| 2018/0351261 | A1 | 12/2018 | Kamo et al. | |
| 2021/0184361 | A1 * | 6/2021 | Ghiotto | H01Q 13/28 |

OTHER PUBLICATIONS

CN106207357, Dec. 7, 2016, Chengdu Xanaway Technology Co., Ltd., Machine Translation (58 pages).

Goussetis, G. et al., Tailoring the AMC and EBG characteristics of periodic metallic arrays printed on grounded dielectric substrate, IEE Transactions on Antennas and Propagation, vol. 51, No. 1, Jan. 2006 (10 pages).

* cited by examiner

WAVEGUIDE SIGNAL CONFINEMENT STRUCTURES AND RELATED SENSOR ASSEMBLIES

SUMMARY

Disclosed herein are various embodiments of sensor and/or antenna assemblies comprising signal confinement structures for preventing leakage and/or otherwise confining electromagnetic signals and/or waves from an operably coupled waveguide of the assembly. In preferred embodiments, such assemblies may comprise RADAR sensor modules for vehicles, including one or more novel and inventive features disclosed herein. For example, some preferred embodiments may comprise a rectangular-type waveguide and antenna with radiating slots suitable for mass fabrication but not requiring the commonly used substrate patch antennas.

In a more particular example of an antenna module, such as a vehicle RADAR module according to some embodiments, the module may comprise an antenna block defining a waveguide. A conductive layer may be coupled to the antenna block and may form, at least in part, a wall of the waveguide, such as a "cap" to a groove waveguide. A first periodic structure may be operably coupled to the waveguide and may comprise a first elongated opening and a first series of repeated slots extending at least substantially transverse to the first elongated opening, wherein each of the first series of repeated slots is spaced apart from an adjacent slot in the first series of repeated slots along the first elongated opening.

A second periodic structure may, similarly, be operably coupled to the waveguide, such as along an opposite side of the waveguide vis-à-vis the first periodic structure. The second periodic structure may also comprise a second elongated opening and a second series of repeated slots extending at least substantially transverse to the second elongated opening, wherein each of the second series of repeated slots is spaced apart from an adjacent slot in the second series of repeated slots along the second elongated opening.

In some embodiments, the waveguide may comprise a groove waveguide defined by opposing walls and the conductive layer. Alternatively, the waveguide may be defined by rows of posts defining a waveguide groove therebetween.

In some embodiments, each of the repeated slots of the first and second series of repeated slots may extend in both opposing directions at least substantially transverse from its respective elongated opening of the first and second elongated openings. In some such embodiments, each of the repeated slots of the first and second series of repeated slots may define a rectangular shape, such as a square shape.

In some embodiments, each of the repeated slots of the first and second series of repeated slots may comprise a first slot portion extending in both opposing directions at least substantially transverse from its respective elongated opening of the first and second elongated openings and a second slot portion intersecting the first slot portion and extending in both opposing directions at least substantially transverse from its respective elongated opening of the first and second elongated openings further than the first slot portion.

Some embodiments may further comprise a channel intersecting the first elongated opening at an end of the first elongated opening. In some such embodiments, the channel may extend at least substantially perpendicular to the first elongated opening and/or may intersect the second elongated opening at an end of the second elongated opening.

Some embodiments may further comprise one or more dielectric chambers, each of which may extend below or otherwise adjacent to each of the periodic structures. In some such embodiments, the dielectric chamber(s) may be defined by opposing rows of conductive vias extending along opposing sides of each of the first and second periodic structures.

In some embodiments, the first periodic structure may be formed along a first side of the waveguide and the second periodic structure is formed along a second side of the waveguide opposite the first side. In some such embodiments, the first elongated opening may extend along the first side of the waveguide at least substantially parallel to the waveguide and the second elongated opening may extend along the second side of the waveguide at least substantially parallel to the waveguide.

In an example of a radiofrequency signal confinement assembly according to some embodiments, the assembly may comprise a conductive layer having an elongated opening formed along a surface of the conductive layer. A dielectric chamber may extend underneath the elongated opening such that the elongated opening leads into the dielectric chamber. The assembly may further comprise a second conductive layer spaced apart from the conductive layer such that the dielectric chamber is formed in between the conductive layer and the second conductive layer.

Some embodiments may further comprise one or more periodic structures formed within the conductive layer, the periodic structure extending along an elongated axis. The periodic structure may comprise a series of repeated slots extending at least substantially transverse to the elongated opening, wherein each of the series of repeated slots is spaced apart from an adjacent slot in the series of repeated slots along the elongated opening.

Some embodiments may comprise one or more dielectric chambers, each of which may extend along a respective periodic structure underneath its respective elongated opening such that the elongated opening leads into the dielectric chamber. Such dielectric chamber(s) may comprise a PCB material or another suitable dielectric material. One or more of the walls/borders of the dielectric chamber(s) may be defined by a first row of conductive vias extending along a first side of the dielectric chamber and a second row of conductive vias extending along a second side of the dielectric chamber opposite the first side of the dielectric chamber. Alternatively, one or more of the walls/borders of the dielectric chamber(s) may be defined by a wholly conductive material adjacent to the material making up the dielectric chamber(s).

Some embodiments may further comprise a second conductive layer spaced apart from the conductive layer such that the dielectric chamber is formed in between the conductive layer and the second conductive layer.

In some embodiments, the elongated opening of the periodic structure(s) may extend at least substantially along a center of the dielectric chamber. The dielectric chamber is preferably wider than the width of the elongated opening, however.

Some embodiments may further comprise one or more channels that may intersect one or more elongated openings (some embodiments may comprise a channel intersecting two parallel elongated openings) at an end of the elongated opening. In some such embodiments, the channel may extend at least substantially perpendicular to the elongated opening.

Some embodiments may further comprise a dielectric chamber extending along the channel underneath the channel such that the channel leads into the second dielectric chamber. The dielectric chamber may interconnect with the second dielectric chamber.

Some embodiments may further comprise various other functional components, such as waveguides, antenna structures, feed structures, housings, etc. For example, some embodiments may further comprise an antenna block defining a waveguide. The periodic structure may then be operably coupled to the waveguide to confine a radiofrequency signal being delivered by the waveguide.

The features, structures, steps, or characteristics disclosed herein in connection with one embodiment may be combined in any suitable manner in one or more alternative embodiments.

BRIEF DESCRIPTION OF THE DRAWINGS

Non-limiting and non-exhaustive embodiments of the disclosure are described, including various embodiments of the disclosure with reference to the figures, in which.

DETAILED DESCRIPTION

A detailed description of apparatus, systems, and methods consistent with various embodiments of the present disclosure is provided below. While several embodiments are described, it should be understood that the disclosure is not limited to any of the specific embodiments disclosed, but instead encompasses numerous alternatives, modifications, and equivalents. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure.

The embodiments of the disclosure may be best understood by reference to the drawings, wherein like parts may be designated by like numerals. It will be readily understood that the components of the disclosed embodiments, as generally described and illustrated in the figures herein, could be arranged and designed in a wide variety of different configurations. Thus, the following detailed description of the embodiments of the apparatus and methods of the disclosure is not intended to limit the scope of the disclosure, as claimed, but is merely representative of possible embodiments of the disclosure. In addition, the steps of a method do not necessarily need to be executed in any specific order, or even sequentially, nor need the steps be executed only once, unless otherwise specified. Additional details regarding certain preferred embodiments and implementations will now be described in greater detail with reference to the accompanying drawings.

Figure 1:
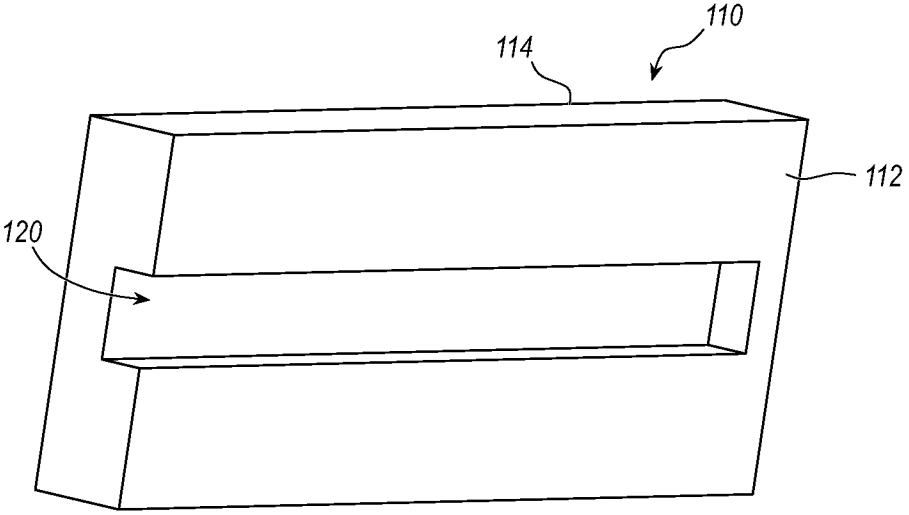
FIG. 1 is a perspective view of a waveguide block according to some embodiments.

FIG. 1 depicts a waveguide and/or antenna block 110 that defines, either in whole or in part, one or more waveguides and may be part of an antenna array comprising one or more antennae, on one or both sides of waveguide block 110. Thus, as depicted in FIG. 1, waveguide block 110 comprises a waveguide 120 formed along side 112 of waveguide block 110. As discussed in greater detail below, in some embodiments, side 114 opposite side 112 may comprise an antenna structure, such as one or more slots for delivery of an electromagnetic signal therethrough. In the depicted embodiment, waveguide 120 is defined by opposing sidewalls and therefore should be considered a "groove" waveguide. However, it is contemplated that, in alternative embodiments, other types of waveguides may be formed, such as waveguides defined by one or more rows of opposing posts, for example.

It should also be understood that although, in preferred embodiments, any number of antennae may be provided and therefore any desired number of corresponding antennae structures—such as a plurality of waveguides, grooves, etc.—may be provided, it is contemplated that some embodiments may comprise an array having a single antenna and therefore only a single waveguide, for example. Such antenna/waveguide/groove may curve about the block/assembly rather than be in a series of parallel lines in some embodiments. As another example, in some embodiments, grooves, slots, or the like may be arranged in a disc formation, or any other suitable formation, including linear, curved, etc. It should also be apparent that several of the accompanying figures depict only certain elements and/or aspects of antenna assemblies and/or waveguides and that, in order to properly function, other elements would typically need to be provided in a complete assembly/module, as those of ordinary skill in the art will appreciate.

In preferred embodiments, waveguide block 110 may comprise a casting, such as a casting comprising a Zinc or other suitable preferably metal material. However, in other contemplated embodiments, block 110 may instead, or in addition, comprise a plastic or other material. In some such embodiments, metallic inserts, coatings, or the like may be used if desired. In typical sensor assemblies, which, as previously mentioned, may be configured specifically for use in connection with vehicles, other structures may be combined with block/casting 110. For example, a slotted layer may be coupled to the waveguide block 110 in some embodiments, in some cases along with other layers and/or elements that are not depicted herein to avoid obscuring the disclosure, to form a more complete antenna assembly. In other embodiments, electromagnetic radiation may be emitted using other slots or openings not formed in a separate layer. For example, in some embodiments, slots may be formed directly in the waveguide block 110 itself.

Preferably, when a slotted layer is present, this layer comprises a metal or other conductive material. Such a slotted layer may be coupled with block 110 in a variety of possible ways. For example, an adhesive, solder, heat stakes, screws, other fasteners, and the like may be used to couple the slotted layer to block 110. Similar structures and/or techniques may be used to couple other layers or other elements of the assembly together, such as coupling the casting to a PCB, for example. In some embodiments, another layer, such as a layer of (preferably conductive) adhesive tape, may be inserted in between block 110 and the slotted layer, which may, either entirely or in part, be used to provide this coupling.

Figure 2:
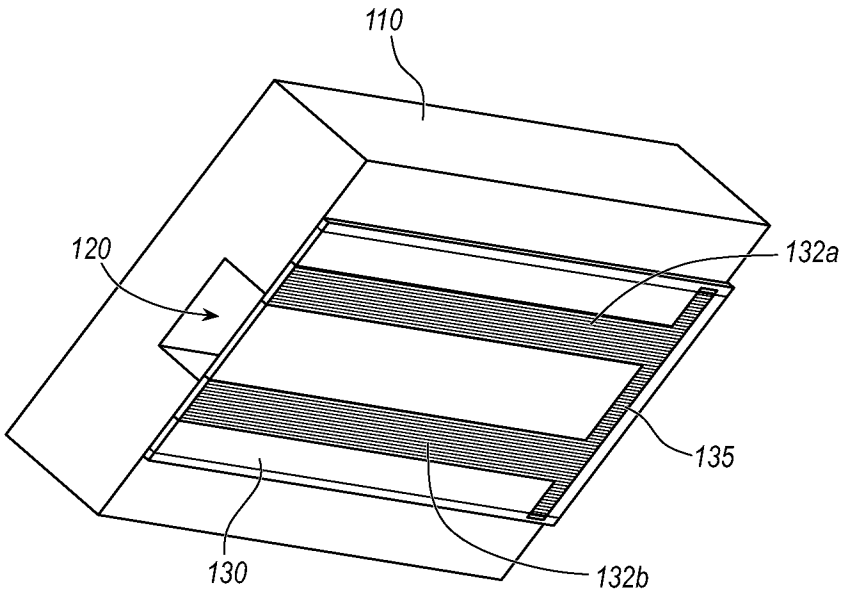
FIG. 2 is a perspective view of the waveguide block of FIG. 1 with a signal confinement structure coupled thereto.

FIG. 2 illustrates waveguide block 110 along with a substrate 130 coupled thereto. As discussed in greater detail below, substrate 130 may comprise one or more layers and/or functional elements that may be used to confine and/or prevent or at least reduce unwanted leakage of electromagnetic energy and/or signals within the waveguide. In some embodiments, substrate 130 may comprise a printed circuit board that may comprise one or more metallic/conductive layers coupled thereto. EM/signal confinement structures may be incorporated into substrate 130, preferably along both sides of the waveguide 120, as shown in FIG. 2.

The bottom surface of substrate/PCB 130 is shown in FIG. 2, which depicts a pair of parallel resonant cavities or chambers 132, namely a first chamber 132*a* extending along a first side of waveguide groove 120 and a second chamber 132*b* extending along a second side of waveguide groove 120. In the depicted embodiment, these chambers 132 extend parallel, or at least substantially parallel, to waveguide groove 120. However, this need not be the case for all contemplated embodiments. Another chamber 135 extends between chambers 132*a* and 132*b* at an end of each respective chamber 132*a*/132*b*. As will be apparent after reviewing this disclosure in its entirety, although not shown in FIG. 2, another similar interconnecting chamber may be formed on the opposite ends of chambers 132*a* and 132*b* if needed/desired.

Chambers 132*a*, 132*b*, and 135 may, in some preferred embodiments, comprise dielectric chambers. In other words, these chambers may be made up of a dielectric material, such as, for example, a glass fiber reinforced (fiberglass) epoxy resin material or the like, a thermoplastic material, or a ceramic material. In some contemplated embodiments, the dielectric chambers may be empty and therefore may be occupied only by air. Although not depicted in FIG. 2, it should be understood that typically another metallic/conductive layer may be coupled to substrate 130, which may serve as a ground layer for the assembly.

Figure 3:
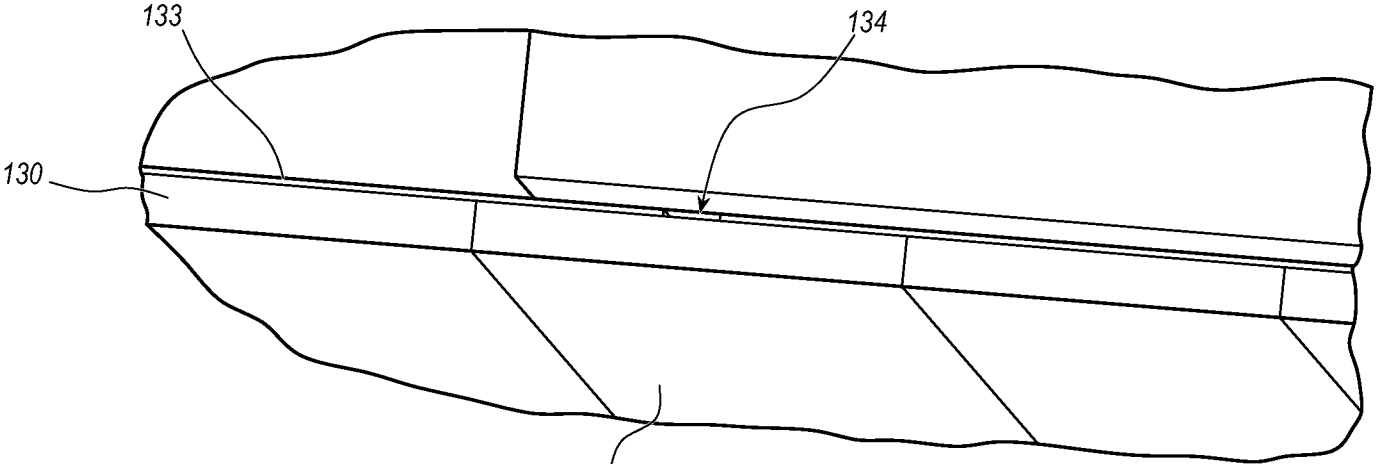
FIG. 3 is an enlarged view of the interface between a line gap of the signal confinement structure and an adjacent waveguide structure.
Figure 4:
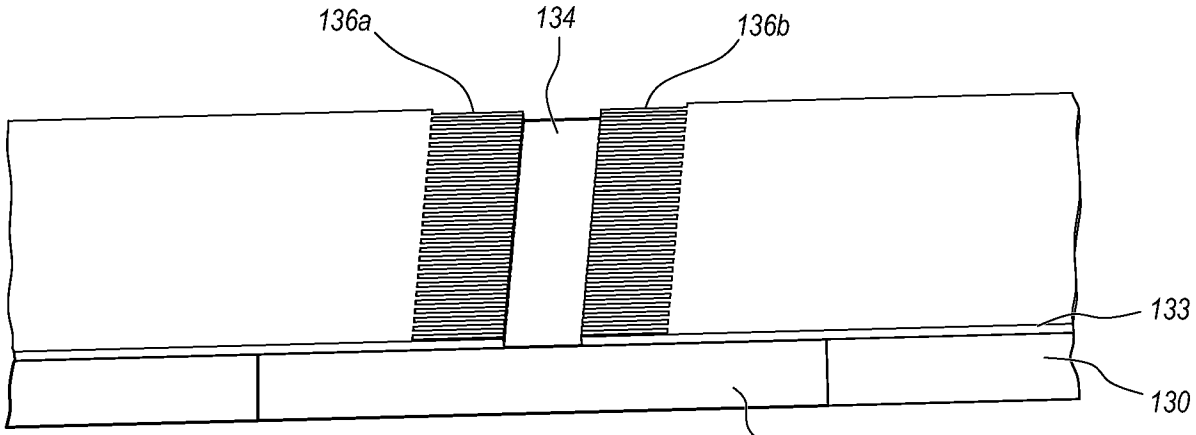
FIG. 4 is another enlarged view of the interface of FIG. 3 illustrating the line gap and a plurality of periodic slots forming a zipper-like structure.

FIG. 3 is an enlarged view of an interface between layer 130 and the adjacent portion of block 110. It may be important for electrical contact to be provided for in this region of the assembly. However, in some embodiments described herein, a gap may be maintained between the adjacent wall of the waveguide/block 110 and the PCB/substrate 130. To avoid or at least reduce signal leakage in this region, one or more preferably metallic and/or electrically conductive structures may be formed within the PCB/substrate layer 130. In the depicted embodiment, these confinement structures comprise first periodic structures operably coupled to the waveguide formed within block 110 that define a zipper-like shape.

More particularly, these periodic structures comprise an elongated opening or slot 134 that preferably extends along a line that may run parallel, or at least substantially parallel, to the adjacent waveguide along one or more sides thereof. This structure is formed in a metallic/conductive layer 133 that is positioned immediately adjacent to the block 110 within which the waveguide or waveguides are formed. The zipper-like confinement structure further comprises a first series of repeated slots 136*a* formed along one side of opening 134 and a second series of repeated slots 136*b* formed along the opposite side of opening 134, both of which extend into the elongated opening 134. In the depicted embodiment, these opposing slots 136 are aligned with one another.

Each of the aforementioned openings/slots extends into a widened dielectric chamber 132 formed at the side of layer 130 opposite the metallic top layer 133. In preferred embodiments, opening 134 is centered, or at least substantially centered, with respect to chamber 132 and slots 136*a*/136*b*, which extend perpendicular to opening 134 in the depicted embodiment, extend only partially from opening 134 to the outer edges of chamber 132. As previously mentioned, chamber 132 preferably comprises a dielectric material, such as a typical material used to manufacture a PCB, such as FR4 material, for example. The outer edges of chamber 132 may be defined by metallic and/or conductive borders, which may either be continuous or, as described in greater detail below, may be defined by a plurality of spaced conductors, such as vias.

In some embodiments, these borders may extend the entire length of chamber 132. In other words, the material on either side of chamber 132 may be continuously metallic/conductive. However, as discussed in greater detail below, other embodiments are contemplated in which these borders may be defined by a series of vias or other spaced conductors, which may extend between opposing metallic/conductive layers of the assembly, such as between layer 133 and an opposing ground layer (not shown) of the assembly. It should be understood that this ground/opposing conductive layer would typically form a lid or other boundary for chamber 132 opposite opening 134.

Figure 5:
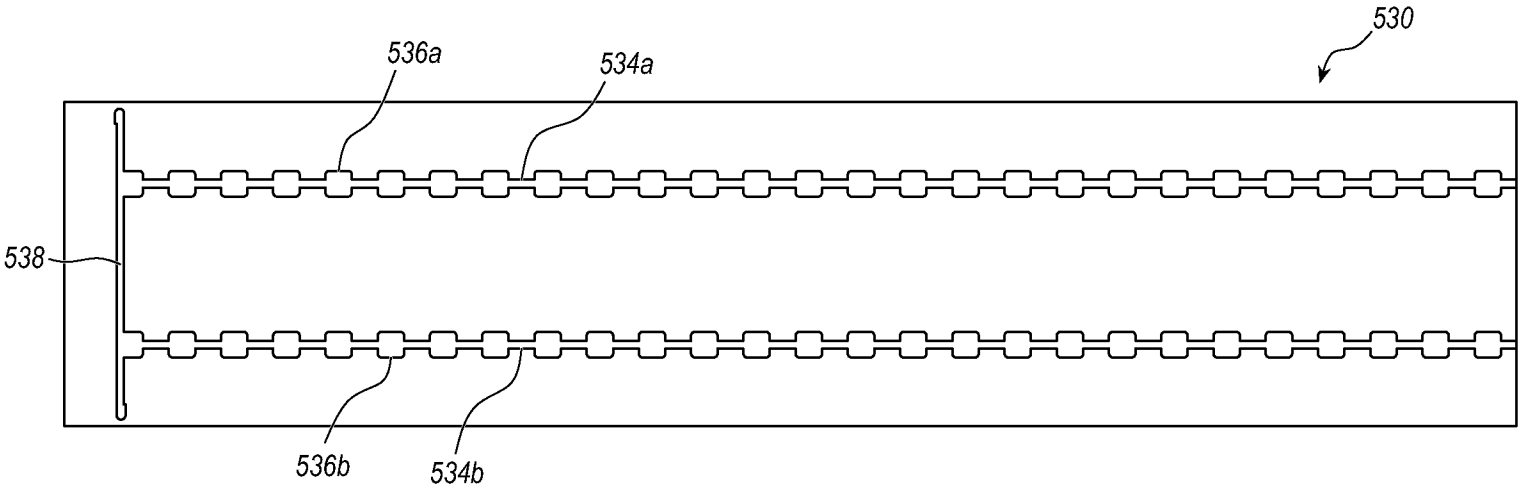
FIG. 5 is a top plan view of a signal confinement layer of a waveguide and/or antenna assembly.
Figure 6:
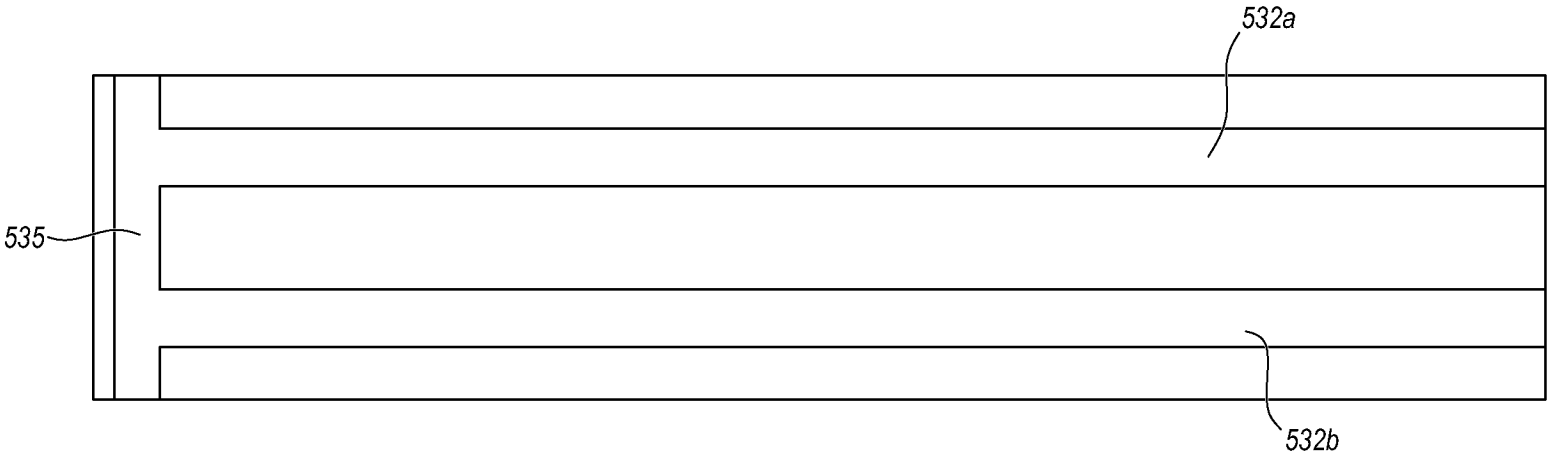
FIG. 6 is a bottom plan view of the signal confinement layer of FIG. 5.

FIGS. 5 and 6 depict an alternative embodiment for a signal confinement layer/structure 530, which may be coupled to a waveguide structure to, as described above, confine associated electromagnetic radiation being carried to and/or from an antenna using the waveguide structure, such as a waveguide structure used in a RADAR module/assembly for a vehicle, for example. Structure 530 again defines two opposing zipper-like structures that may be formed in a extend along opposing sides of an adjacent waveguide.

More particularly, a first opening 534*a* preferably formed along a line extends parallel to a second opening 534*b* that also extends along a line adjacent thereto. Again, typically a waveguide structure would be formed in between openings 534*a* and 534*b*, such as in an adjacent structure layer coupled to layer 530. Again, a series of widened regions or repeated slots 536*a* are formed at repeating intervals along opening 534*a* and a corresponding series of widened regions or repeated slots 536*b* are formed at repeating intervals along opening 534*b*. In this embodiment, slots 536*a* and 536*b* extend in both opposing directions at least substantially transverse from its respective elongated opening 534*a*/534*b*. In addition, each of the repeated slots 536*a* and 536 comprises a rectangular shape.

At respective ends of elongated openings 534*a*/534*b*, a transverse opening or channel 538 is formed, which interconnects openings 534*a*/534*b*. Again, although the opposite end of these elongated openings 534*a*/534*b* is not shown in FIG. 5, it should be understood that an additional traverse opening may be formed at the opposite end and/or at any point between the opposing ends as desired/needed.

A plan view of the opposite side of layer/structure 530 is shown in FIG. 6. As shown in this figure, each of the various slots/opening shown in the side depicted in FIG. 5 has an associated chamber on the opposite side shown in FIG. 6. More particularly, openings/slots 534*a*/536*a* are operably coupled with a dielectric chamber 532*a* adjacent thereto and openings/slots 534*b*/536*b* are operably coupled with dielectric chamber 532*b*. Similarly, transverse opening/channel 538 is operably coupled with a transverse, dielectric chamber 535. As previously described, typically the side of layer/structure depicted in FIG. 5 would comprise a metallic/conductive portion into which the various signal confinement structures shown are formed and the side depicted in FIG. 6 would be closed or otherwise coupled with an opposite metallic/conductive layer not shown in FIG. 6.

The width of the lines of openings 534*a*/534*b* may be relatively thin. Thus, in some embodiments, this width may be just sufficient to be maintained even when the structure is under etched, which preferred thickness may therefore vary by application/material. The preferred width of the dielectric chambers 532*a*/532*b* beneath the line of openings 534*a*/534*b* may, in some embodiments, be about half the wavelength of the dielectric material used to form these chambers.

As for the repeating slot portions of the confinement structure, the period of these slots 536*a*/536*b* may be of the same order of magnitude as the guide wavelength of the mode propagating tangential to the line formed by openings 534*a*/534*b*. In embodiments in which the slots 536*a*/536*b* comprise rectangular shapes, these rectangles may, in some embodiments, comprise a length of about half the period of the repeating pattern (the length measured along the axis of the associated opening 534*a*/534*b*. However, it should be understood that the width of the dielectric chambers 532*a*/532*b* should typically be about half of the wavelength of the dielectric material used to form the chambers. In addition, the period of the slots 536*a*/536*b* may be similar to the guide wavelength. Alternatively, or additionally, the period of the slots 536*a*/536*b* may be similar to the high frequency beat wavelength between the wavelength in the waveguide and the chamber.

Figure 7:
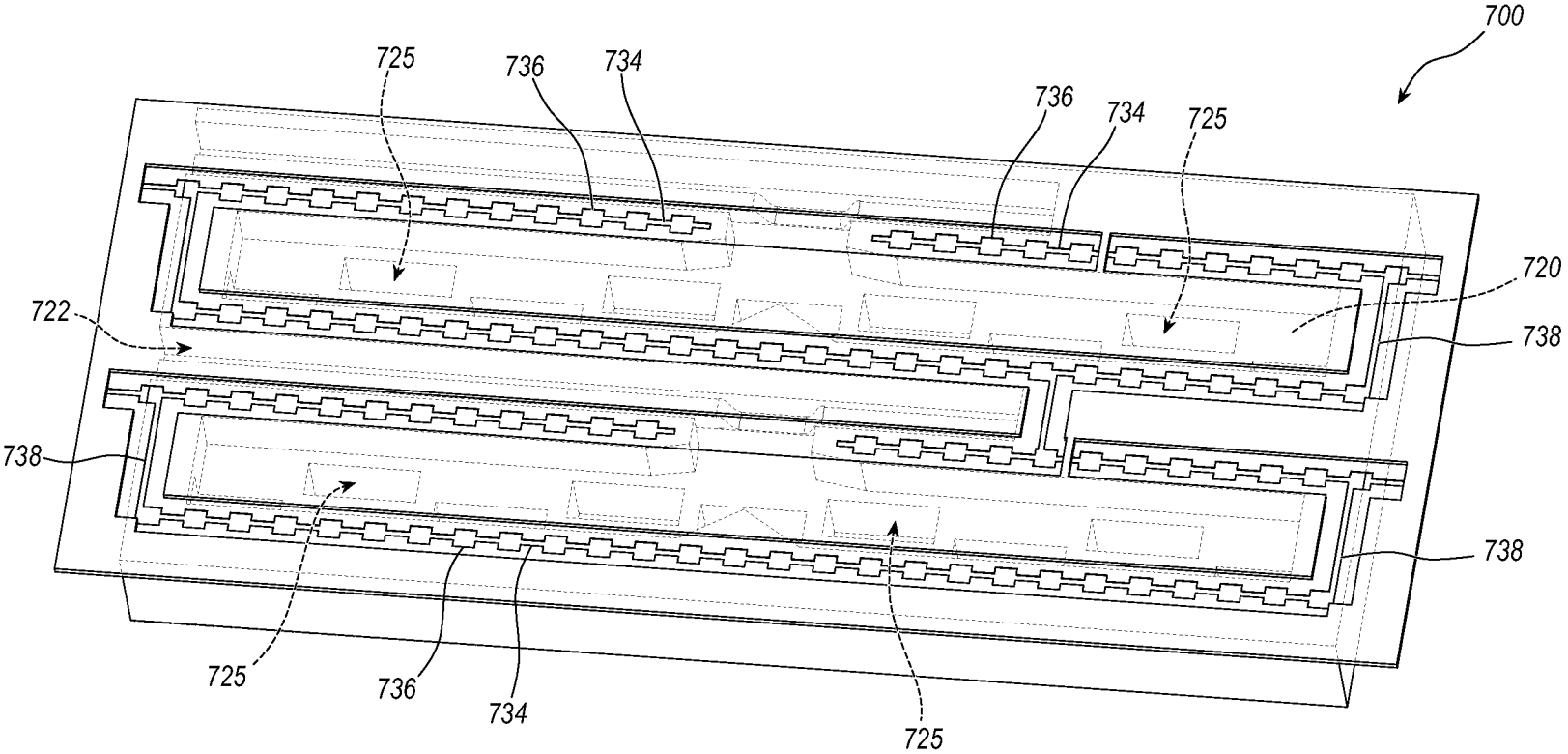
FIG. 7 depicts an assembly comprising a waveguide, antenna structure, and operably coupled periodic structure for confinement of EM energy within the waveguide.
Figure 8:
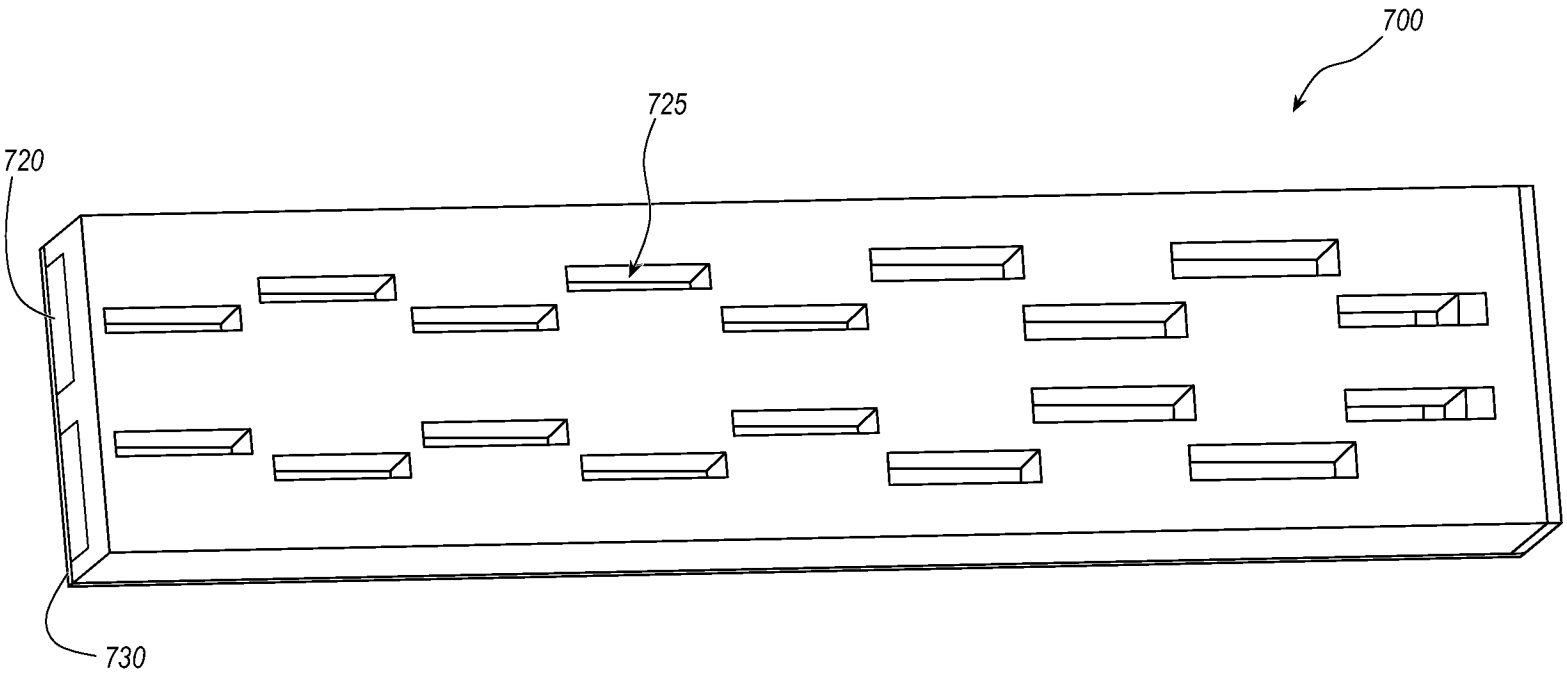
FIG. 8 is a perspective view of the assembly of FIG. 7.

FIGS. 7 and 8 depict a more complete assembly 700, such as a RADAR or other sensor assembly, according to some embodiments. As shown in FIG. 7, assembly 700 may comprise one or more waveguides 720 configured to guide a signal and/or electromagnetic energy therein along with respective, adjacent antenna structures each made up of a series of spaced slots 725 through which electromagnetic waves may be transmitted and/or received. Slots 725 may be formed in an adjacent layer/structure to waveguides 720 or, alternatively, may be formed in the same structure, such as in a waveguide and/or antenna block similar to block 110.

As also shown in FIG. 7, one or more feed waveguides 722 may be used to introduce a signal into one or more of the aforementioned waveguides 720. In some embodiments, such feed waveguide 722 structures may comprise a waveguide comprising an elongated ridge positioned therein. Thus, an elongated ridge may be, for example, positioned between opposing rows of posts and/or between opposing sidewalls of a groove-style waveguide. Such ridges may be preferred to enhance the characteristics of the waveguide by further facilitating guidance of electromagnetic waves as desired and/or for satisfying size/dimensional demands.

Signal confinement structures are formed adjacent to and are operably coupled with each of the waveguides 720. Thus, elongated slots or openings 734 are formed along opposing sides of the elongated axes of each of the waveguides 720. In addition, a series of repeating widened sections or slots 736 are formed along openings 734, which, as previously mentioned, are preferably formed in a metallic layer and/or portion of a PCB or other similar adjacent layer/structure of assembly 700. In the depicted embodiment, each of the slots 736 comprises a rectangular shape that extends in both directions vis-à-vis the elongated opening 734. Again, a wide variety of alternative shapes, sizes, and configurations are contemplated, however. In addition, the signal confinement structure may further comprise various transverse slots 738 that may be used to functionally and/or physically interconnect adjacent elongated openings 734 formed on opposing sides of a particular waveguide 720.

FIG. 8 depicts assembly 700 in a stacked configuration from the side of slots 725. As shown in this figure, slots 725 may be staggered back and forth adjacent to a particular waveguide 720 of the plurality of waveguides 720, preferably such that the center of the adjacent waveguide 720 extends in between the adjacent, staggered antenna slots 725. As also shown in FIG. 8, opposite the antenna slots 725, a substrate 730 may be provided, which may comprise, for example, a printed circuit board and/or one or more metallic/conductive layers. As previously mentioned, the EM/signal confinement structures may be formed within substrate 730. More particularly, in some preferred embodiments, the openings 734 and slots 736 shown in FIG. 7 may be formed in a metallic/conductive layer of substrate 730 and, although not shown in the figures, dielectric chambers may be formed adjacent to openings 734, preferably such that openings 734 lead into the adjacent dielectric chamber, which is preferably wider than openings 734 and/or such that openings 734 are centered, or at least substantially centered, with respect to the adjacent dielectric chamber, which may comprise a PCB material or any other desired, preferably dielectric, material.

As also shown in FIG. 8, the slots 725 may be arranged to be symmetric to the symmetry line(s) of the respective antennas. More particularly, as shown in FIG. 8, the distance between the first, third, and fifth slots 725 of one antenna and the respective first, third, and fifth slots 725 of the second antenna may be constant, or at least substantially constant. By contrast, the distance between the second, fourth, and sixth slots 725 of one antenna and the respective second, fourth, and sixth slots 725 of the second antenna continuously varies. This configuration may ensure that the power coupled through the slots does not superimpose in phase.

Figure 9:
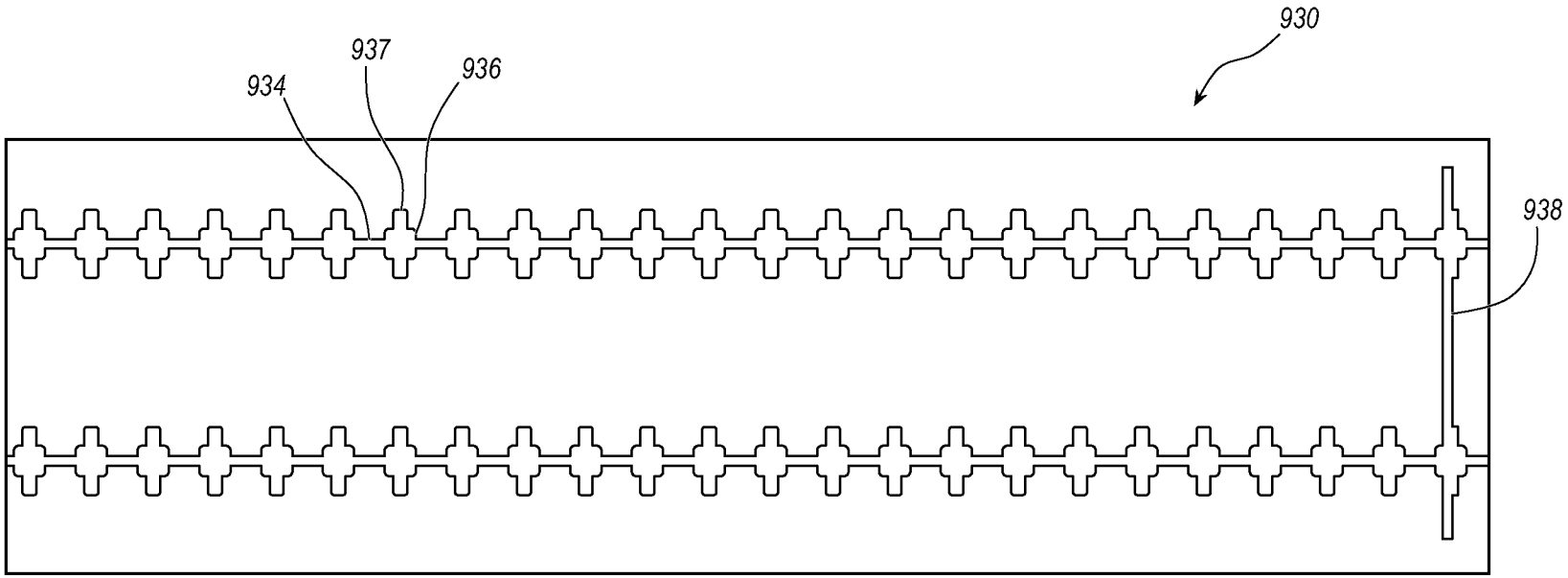
FIG. 9 is a top plan view of an alternative embodiment of a signal confinement structure and/or layer.

FIG. 9 depicts an EM/signal confinement structure 930 according to other embodiments. Structure 930 may be formed within a substrate layer in some embodiments. As with other such structures discussed in connection with previous figures, structure 930 comprises a pair of opposing elongated, openings 934, which may extend along opposing sides of an adjacent waveguide, for example. At repeated, spaced intervals along these opposing openings 934, slots are formed that comprise two slot portions.

Each repeating slot therefore comprises a first slot portion 936 that extends in both opposing directions that are transverse, or at least substantially transverse, from its respective elongated opening 934. Each repeating slot further comprises a second slot portion 937 that intersects the first slot portion 936 and extends in both of the aforementioned opposing directions transverse, or at least substantially transverse, from its respective elongated opening 934 but to a further extent than the first slot portion 936 forming, in essence, a slot within a slot. Interconnecting/transverse channels 938 may be formed to connect opposing sides/portions of structure 930 if desired. Channel(s) 938 may act as a blockage structure as the phase front of the wave to be blocked is parallel to channel 938. Although not shown in FIG. 9, it should be understood that, in preferred embodiments, dielectric chambers may be formed underneath elongated openings 934 and/or transverse channels 938, as previously described.

The alternative structure of the confinement structure of FIG. 9 may provide additional transverse slots 937 to reduce the length of a standing wave established in the space approximately between the zipper line and the nearest waveguide vertical wall. The standing wave typically exists while the waveguide is separated from the confinement structure by a small gap. This standing wave can extend significantly into the waveguide and perturb the main propagating mode such that the radiating slot period is no longer matched to the main mode guided wavelength, resulting in undesired beam squint. The additional transverse slots can help mitigate this effect and reduce the squint.

Figure 10:
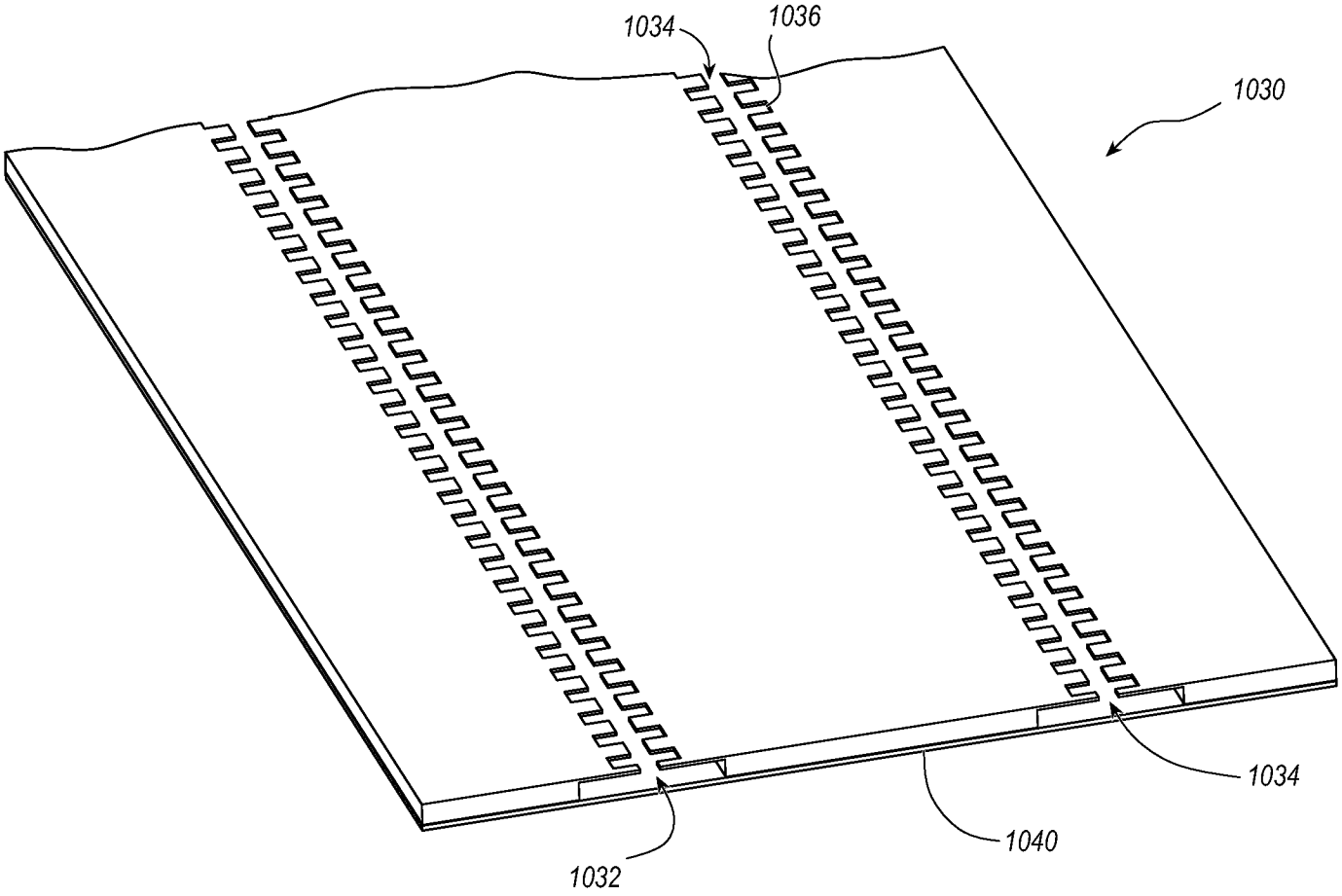
FIG. 10 is a perspective view of a signal confinement layered structure comprising a resonant chamber formed below a periodic structure formed in a metallic portion of the structure.

FIG. 10 is a partial, perspective view of a substrate 1030 comprising a zipper-like EM/signal confinement structure according to other embodiments. As shown in this figure, substrate 1030 may comprise a metallic/conductive upper layer/portion into which is formed a series of openings 1034 and/or slots 1036 for confining an EM signal within an adjacent waveguide structure (not shown). These slots/openings form a zipper-like structure and are coupled to an adjacent dielectric chamber 1032 formed underneath each of the openings 1034. A ground layer 1040, which may comprise another conductive/metallic material, may be used to close off each of the dielectric chambers 1032.

Thus, dielectric chambers 1032 may be defined by opposing metallic/conductive layers/material on the top and bottom thereof and may be opened to allow for interaction with adjacent EM signals by virtue of the various openings 1034 and/or slots 1036. The opposing sides of the dielectric chambers 1032 may be defined in a variety of ways. For example, in the embodiment depicted in FIG. 10, the opposing walls may be defined by metallic/conductive material and the material making with the dielectric chambers 1032 may be any of the previously-mentioned dielectric materials. However, in alternative embodiments, including the embodiment shown in FIG. 11, these sidewalls may be defined in part by conductive material and partly by dielectric material, such as by forming opposing rows of vias within a PCB-material, for example.

Figure 11:
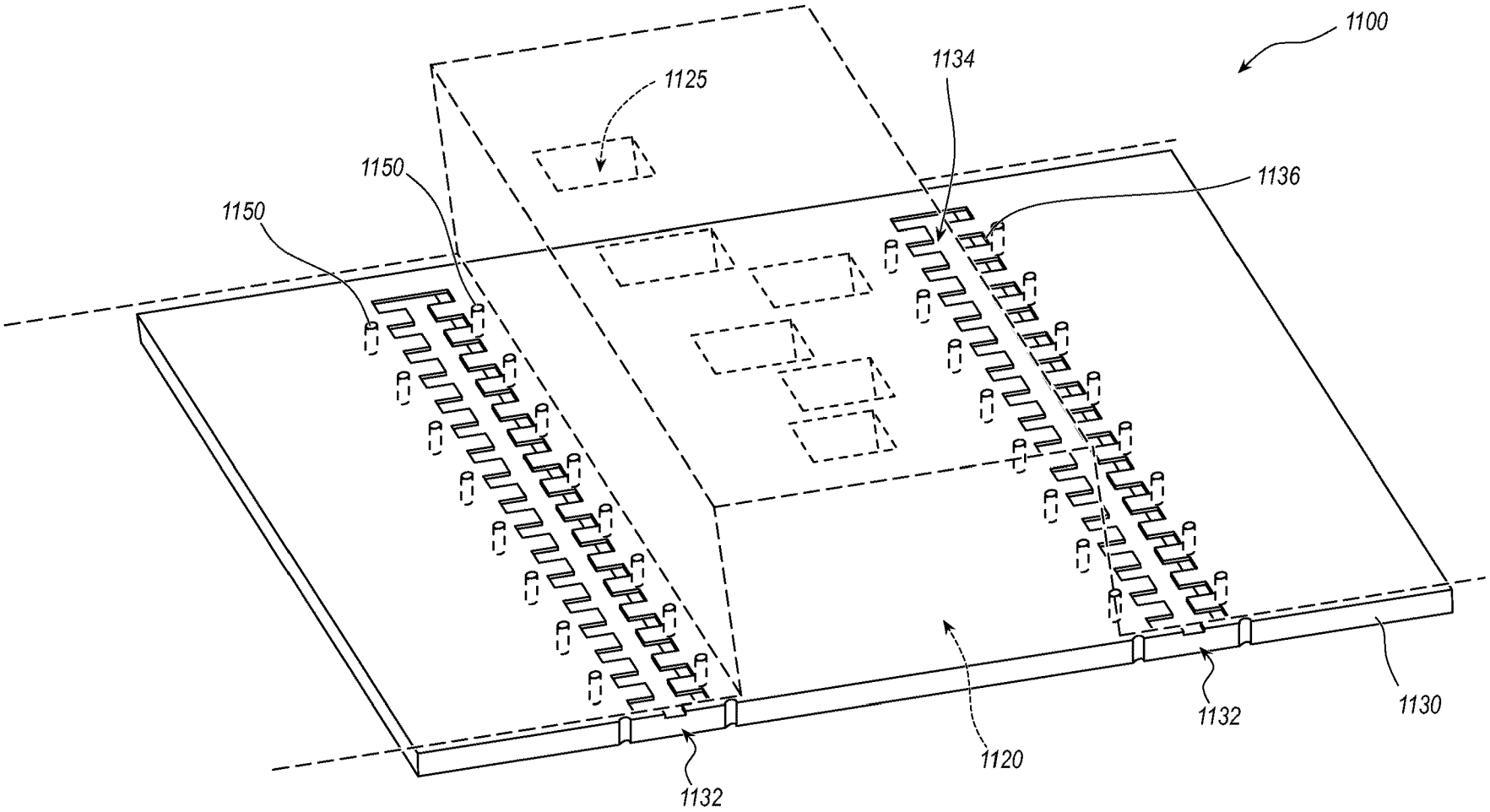
FIG. 11 depicts an alternative signal confinement structure comprising a resonant chamber defined in part by a plurality of spaced vias.

FIG. 11 depicts an alternative waveguide/antenna assembly 1100 according to other embodiments. A waveguide 1120 may be formed by, for example, forming a groove within a block structure, for example. Such groove may be formed by, for example, a plurality of adjacent posts or by a more traditional, trench-style waveguide groove. A series of adjacent antenna slots 1125 may be formed, for example, in either the same block structure or an adjacent layer of the assembly 1100. EM/signal confinement structures may be formed on one or both opposing sides of waveguide 1120, which structures may be defined by elongated openings 1134 and transverse slots 1136, as discussed throughout this disclosure.

However, unlike embodiments discussed in connection with previous figures, substrate 1130 may primarily comprise a dielectric material throughout with the exceptions of (1) a metallic/conductive layer or portion into which the aforementioned signal confinement structures may be formed; and (2) a plurality of conductive vias 1150 that may extend from the aforementioned conductive layer to a ground layer (not shown), for example. Thus, the opposing rows of vias 1150 may define opposing borders of respective dielectric chambers 1132 that are formed under respective openings 1134. Dielectric chambers 1132 may otherwise have any of the shapes, dimensions, and/or features previously mentioned.

Figure 12:
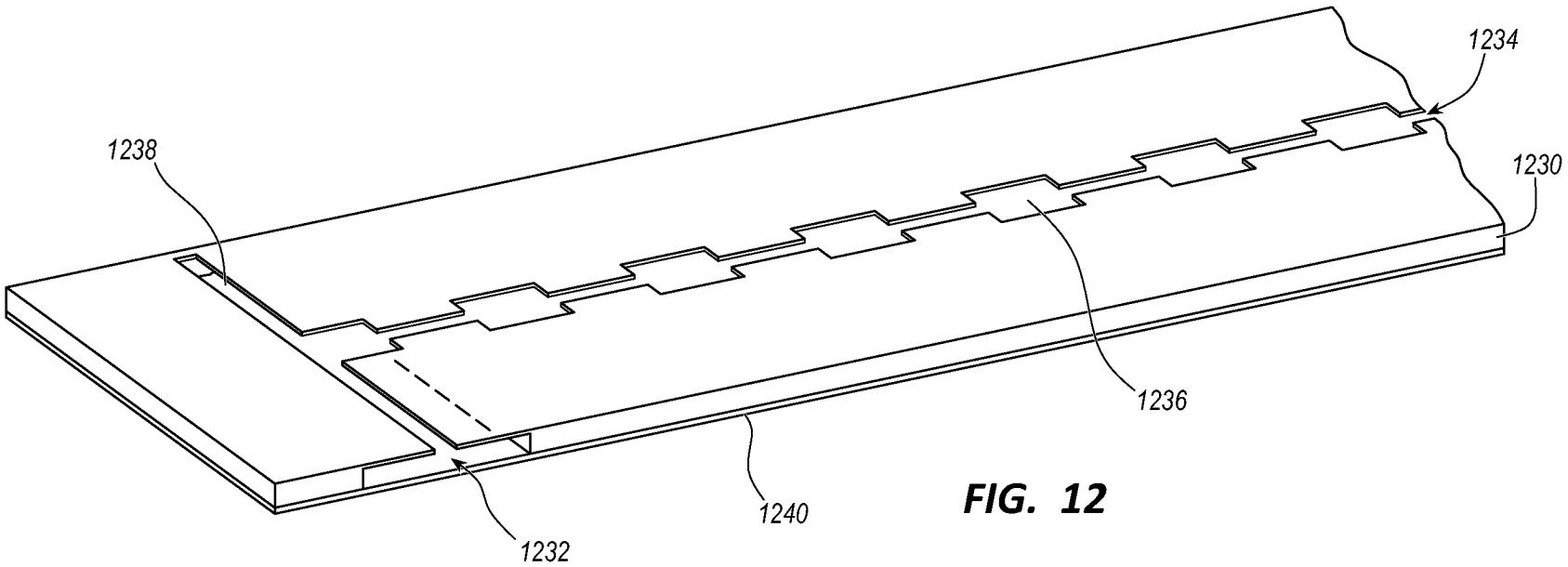
FIG. 12 depicts an alternative signal confinement structure comprising an interconnecting channel also having an associated resonant chamber.

A partial, phantom view of a signal confinement structure of another embodiment is shown in FIG. 12 and comprises a linear opening 1234 having a plurality of periodic, widened portion or slots 1236 formed in a substrate 1230. A transverse slot 1238 is formed at a terminal end of linear opening 1234 and a dielectric chamber 1232 is formed within the line formed by transverse slot 1238. Again, dielectric chamber 1232 may be defined by a ground and/or conductive cap layer 1240 and may widen on both sides of the line formed by slot 1238. Again, the opposing borders of chamber 1232 along the sides may be defined by metallic material within substrate 1230 or may be defined by spaced metallic elements, such as the vias previously mentioned. In addition, it should be understood that, although not shown in FIG. 12, a similar dielectric chamber may be formed underneath linear opening 1234. Similarly, dielectric chambers, although not shown in connection with each figure presented herein, may be formed under or otherwise adjacent to any of the other transverse slots/openings shown and/or described herein.

Figure 13:
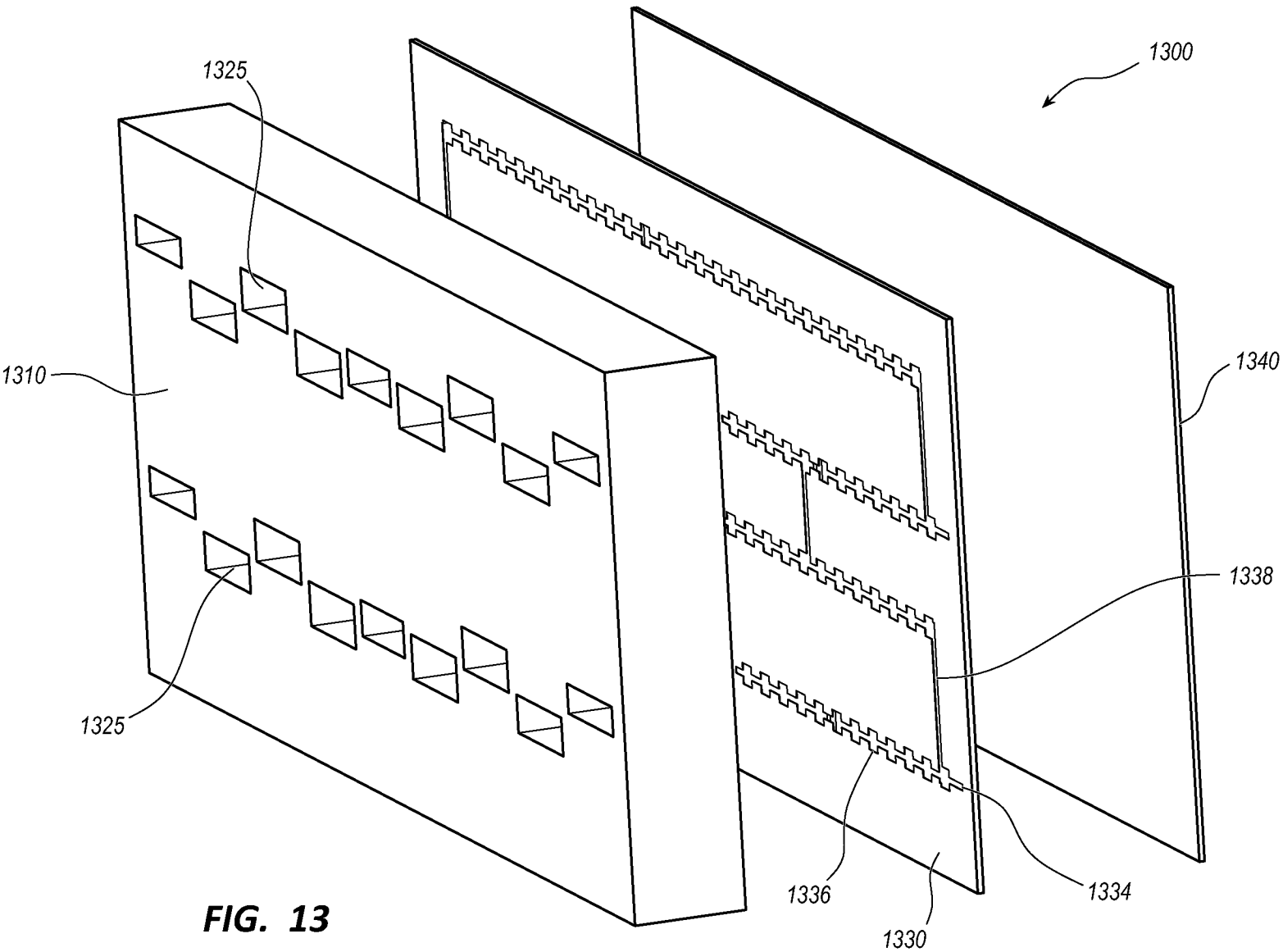
FIGS. 13 and 14 are exploded views of a waveguide and antenna assembly comprising a signal confinement structure formed in a separate layer of the assembly.
Figure 14:
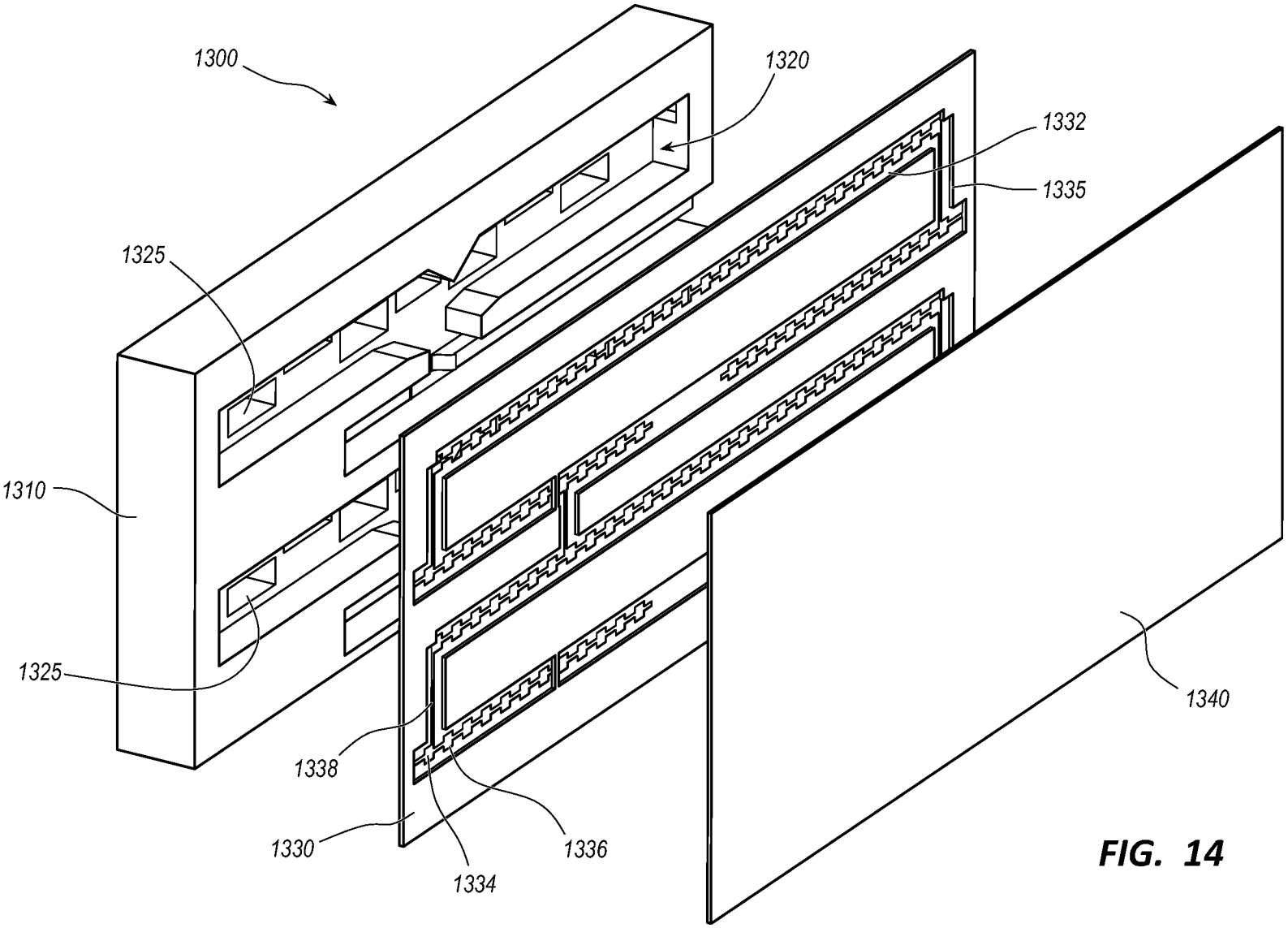

FIGS. 13 and 14 are exploded views of a waveguide/antenna assembly 1300 according to still other embodiments. Assembly 1300 comprises a first layer 1310 comprising two parallel groove waveguides 1320 each having a plurality of corresponding antenna slots 1325, which may be formed in a staggered manner within each associated waveguide 1320, as best shown in FIG. 14. A substrate layer 1330 may be coupled to layer 1310 and may comprise a conductive portion and/or layer positioned immediately adjacent to waveguides 1320. A periodic structure may be formed within this conductive layer/portion to assist in confinement of the electromagnetic signal contained within the waveguides 1320.

More particularly, a confinement structure comprising a series of parallel, linear openings 1334 and a plurality of interconnecting linear openings 1335 are formed. Linear openings 1334 comprise a series of periodic slots 1336, as mentioned throughout this disclosure. In addition, as best shown in FIG. 14, the opposing walls of a series of dielectric chambers are shown formed adjacent to their respective, aforementioned openings and/or periodic structures. Thus, dielectric chambers 1332 are formed along linear openings 1334 and interconnecting dielectric chambers 1335 extend between respective ends of parallel linear openings 1334 along linear openings 1338. As previously mentioned, any of these dielectric chambers 1332/1335 may comprise a PCB material inside and may be defined, at least in part, by metallic/conductive material, such as ground layer 1340, an opposing metallic/conductive layer, which may be part of layer 1330, by metallic/conductive material within layer 1330, and/or by a series of conductive elements, such as vias. Thus, the gaps shown in FIG. 14 that make up, at least in part, chambers 1332 and 1335 may ultimately be occupied by a PCB or another dielectric material. Thus, because air may be a suitable dielectric material for some applications, in other embodiments, chambers 1332 and/or 1335 may instead be empty (or occupied only by air).

It should also be understood that whereas preferred embodiments may be used in connection with vehicle sensors, such as vehicle RADAR modules or the like, the principles disclosed herein may be used in a wide variety of other contexts, such as other types of RADAR assemblies, including such assemblies used in aviation, maritime, scientific applications, military, and electronic warfare. Other examples include point-to-point wireless links, satellite communication antennas, other wireless technologies, such as 5G wireless, and high-frequency test and scientific instrumentation. Thus, the principles disclosed herein may be applied to any desired communication sub-system and/or high-performance sensing and/or imaging systems, including medical imaging, security imaging and stand-off detection, automotive and airborne radar and enhanced passive radiometers for earth observation and climate monitoring from space.

The foregoing specification has been described with reference to various embodiments and implementations. However, one of ordinary skill in the art will appreciate that various modifications and changes can be made without departing from the scope of the present disclosure. For example, various operational steps, as well as components for carrying out operational steps, may be implemented in various ways depending upon the particular application or in consideration of any number of cost functions associated with the operation of the system. Accordingly, any one or more of the steps may be deleted, modified, or combined with other steps. Further, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced, are not to be construed as a critical, a required, or an essential feature or element.

Those having skill in the art will appreciate that many changes may be made to the details of the above-described embodiments without departing from the underlying principles of the invention. The scope of the present inventions should, therefore, be determined only by the following claims.

The invention claimed is:

1. An antenna module, comprising:

an antenna block defining a waveguide;

a conductive layer coupled to the antenna block, wherein the conductive layer forms, at least in part, a wall of the waveguide;

a first periodic structure operably coupled to the waveguide, the first periodic structure comprising:

a first elongated opening; and a first series of repeated slots extending at least substantially transverse to the first elongated opening, wherein each of the first series of repeated slots is spaced apart from an adjacent slot in the first series of repeated slots along the first elongated opening; and a second periodic structure operably coupled to the waveguide, the second periodic structure comprising:

a second elongated opening; and a second series of repeated slots extending at least substantially transverse to the second elongated opening, wherein each of the second series of repeated slots is spaced apart from an adjacent slot in the second series of repeated slots along the second elongated opening.

2. The antenna module of claim 1, wherein the waveguide comprises a groove waveguide defined by opposing walls and the conductive layer.

3. The antenna module of claim 1, wherein each of the repeated slots of the first and second series of repeated slots extends in both opposing directions at least substantially transverse from its respective elongated opening of the first and second elongated openings.

4. The antenna module of claim 3, wherein each of the repeated slots of the first and second series of repeated slots comprises a rectangular shape.

5. The antenna module of claim 4, wherein each of the repeated slots of the first and second series of repeated slots comprises:

a first slot portion extending in both opposing directions at least substantially transverse from its respective elongated opening of the first and second elongated openings; and a second slot portion intersecting the first slot portion and extending in both opposing directions at least substantially transverse from its respective elongated opening of the first and second elongated openings further than the first slot portion.

6. The antenna module of claim 1, further comprising a channel intersecting the first elongated opening at an end of the first elongated opening, the channel extending at least substantially perpendicular to the first elongated opening.

7. The antenna module of claim 6, wherein the channel intersects the second elongated opening at an end of the second elongated opening.

8. The antenna module of claim 1, further comprising a dielectric chamber extending adjacent to each of the first and second periodic structures.

9. The antenna module of claim 8, wherein the dielectric chamber is defined by opposing rows of conductive vias extending along opposing sides of each of the first and second periodic structures.

10. The antenna module of claim 1, wherein the first periodic structure is formed along a first side of the waveguide, and wherein the second periodic structure is formed along a second side of the waveguide opposite the first side.

11. The antenna module of claim 10, wherein the first elongated opening extends along the first side of the waveguide at least substantially parallel to the waveguide, and wherein the second elongated openings extends along the second side of the waveguide at least substantially parallel to the waveguide.

12. A radiofrequency signal confinement assembly, comprising:

a conductive layer;

an elongated opening formed along a surface of the conductive layer;

a dielectric chamber extending underneath the elongated opening such that the elongated opening leads into the dielectric chamber, wherein the dielectric chamber is defined by a first row of conductive vias extending along a first side of the dielectric chamber and a second row of conductive vias extending along a second side of the dielectric chamber opposite the first side of the dielectric chamber; and a second conductive layer spaced apart from the conductive layer such that the dielectric chamber is formed in between the conductive layer and the second conductive layer.

13. The radiofrequency signal confinement assembly of claim 12, further comprising a periodic structure formed within the conductive layer, the periodic structure extending along an elongated axis, wherein the periodic structure comprises:

a series of repeated slots extending at least substantially transverse to the elongated opening, wherein each of the series of repeated slots is spaced apart from an adjacent slot in the series of repeated slots along the elongated opening.

14. The radiofrequency signal confinement assembly of claim 12, wherein the elongated opening extends at least substantially along a center of the dielectric chamber.

15. The radiofrequency signal confinement assembly of claim 12, wherein the dielectric chamber comprises a PCB material.

16. The radiofrequency signal confinement assembly of claim 12, further comprising a channel intersecting the elongated opening at an end of the elongated opening, the channel extending at least substantially perpendicular to the elongated opening.

17. The radiofrequency signal confinement assembly of claim 16, further comprising a second dielectric chamber extending along the channel underneath the channel such that the channel leads into the second dielectric chamber.

18. The radiofrequency signal confinement assembly of claim 17, wherein the dielectric chamber interconnects with the second dielectric chamber.

19. The radiofrequency signal confinement assembly of claim 12, further comprising an antenna block defining a waveguide, wherein a periodic structure is operably coupled to the waveguide to confine a radiofrequency signal being delivered by the waveguide.

20. A radiofrequency signal confinement assembly, comprising:

an antenna block defining a waveguide, wherein a periodic structure is operably coupled to the waveguide to confine a radiofrequency signal being delivered by the waveguide;

a conductive layer;

an elongated opening formed along a surface of the conductive layer;

a dielectric chamber extending underneath the elongated opening such that the elongated opening leads into the dielectric chamber; and a second conductive layer spaced apart from the conductive layer such that the dielectric chamber is formed in between the conductive layer and the second conductive layer.

* * * * *